United States Patent [19]

Burrola

[11] Patent Number: 4,624,323

[45] Date of Patent: Nov. 25, 1986

[54] MULTI-PURPOSE IMPACT HAND TOOL KIT

[76] Inventor: Henry G. Burrola, 232 W. Pastime Rd., Tucson, Ariz. 85705

[21] Appl. No.: 699,047

[22] Filed: Feb. 7, 1985

[51] Int. Cl.[4] ..... B25D 17/00; B21D 1/12

[52] U.S. Cl. ..... 173/90; 173/128; 72/457

[58] Field of Search ..... 173/90, 91, 128; 81/463; 72/457, 479, 481

[56] References Cited

U.S. PATENT DOCUMENTS

| | | | |
|---|---|---|---|
| 2,475,041 | 7/1949 | Mattson | 173/91 X |
| 2,839,754 | 6/1958 | Pfaff | 1/47 |
| 2,923,335 | 2/1960 | Joyce | 145/1 |
| 2,934,984 | 5/1960 | Woodman | 81/15 |
| 2,941,429 | 6/1960 | Mason | 81/15 |
| 3,519,087 | 7/1970 | Santi | 173/91 |
| 3,529,497 | 9/1970 | Brooks | 81/52.35 |
| 3,570,289 | 3/1971 | Smyens | 173/91 X |
| 3,750,500 | 8/1973 | Peterson | 81/463 |
| 4,072,042 | 2/1978 | Servin et al. | 72/457 |
| 4,458,415 | 7/1984 | Maher et al. | 81/463 |

OTHER PUBLICATIONS

Star Expansion Industries Catalog, Mountainville, N.Y., 10953, 1981, pp. 3, 4, 32, 34, 36.

*Primary Examiner*—E. R. Kazenske

*Assistant Examiner*—Willmon Fridie, Jr.

*Attorney, Agent, or Firm*—Victor Flores

[57] ABSTRACT

An improved multi-purpose impact hand tool kit for use by electricians, carpenters or similar tradesperson in the building construction industry or other similar industry in applications that require the use of an impact type of hand tool for driving fastening devices such as concrete nails, threaded or unthreaded fastener studs, pins anchor/expansion plugs or similar devices. The improved impact hand tool kit conveniently provides for the tradesperson an elongated shaft provided with a tool end having exterior threads and a threaded bore for attaching male or female threaded attachment ends provided on commercially available fastening devices. The improved hand tool kit can also be used by the tradesperson in general applications that require the use of an impact or non-impact general purpose hand tools such as chisels, punches, and screwdrivers. Such impact or non-impact general purpose hand tools are specially adapted for use with the elongated shaft of the improved impact hand tool kit. The improved impact hand tool kit is also provided with simple reducer adapters which will allow the use of fastening devices or specially adapted general purpose impactor non-impact hand tools having their attachment ends with a reduced thread size. The improved impact hand tool kit is provided with features that add utility, comfort, durability and safety during its use.

3 Claims, 3 Drawing Figures

MULTI-PURPOSE IMPACT HAND TOOL KIT

BACKGROUND OF THE INVENTION

1. Field of the Invention

The present invention generally relates to impact hand tools for use in the masonry, carpentry, electrical or similar engineering fields and more particularly, is concerned with an improved heavy duty impact hand tool kit for driving fastening devices such as threaded fastener studs, anchor/expansion plugs, nails, pins into densily packed material such as concrete, metal framing material used in the building industry or for general use in these engineering fields where a particular job may require the use of impact or non-impact general purpose hand tools such as chisels, screwdrivers, punches or similar hand tools.

2. Description of the Prior Art

In the building construction industry, and other similar industry, there is a constant need to have a hand tool which can be used to drive fastening devices such as concrete nails, threaded or unthreaded fastener studs, anchor/expansion plugs and other similar devices into solid surfaces such as concrete or into metal framing studs such as those presently being used in the building industry. There is also a similar need to have an impact hand tool for general use where ordinarily a impact or non-impact general purpose hand tool such as a punch, chisel or screwdriver would be used. Presently, tools that can be used to fulfill this need are either too expensive for everyday use or lack the versatility to be adapted to a variety of jobs requiring an impact hand tool. Typical tools used presently in the trade vary from high power tools such as the expensive pistol tool requiring 22 caliber pistol loads to impact hand tools which will only accomodate one type of fastening device. Other tools known which attempt to resolve the lack of versitility do so only in a limited way and with the use of costly adapters which tend to detract from their utility. Additionally, the tools which attempt the versatility, are specialized for use in one particular trade.

Consequently, a need exists for a simple, affordable and versatile impact hand tool which can be used by the tradesperson in the building construction industry or similar industries for impact driving fastening devices or for general impact hand tool use. Such impact hand tool would find utility by being easily adapted to the particular job requiring the use of an impact hand tool.

SUMMARY OF THE INVENTION

The principal object of the invention is directed at providing for the tradesperson in the building construction industry with an improved impact hand tool kit which can be used in applications which require the use of an impact type of hand tool for driving fastening devices such as concrete nails, threaded or unthreaded fastener studs, pins or similar devices. The improved impact hand tool kit conveniently provides for the tradesperson an elongated shaft provided with a tool end having exterior threads and a threaded bore end suitably threaded for attaching male or female threaded attachment ends provided on commercially available fastening devices.

Another object of the invention is directed at providing the tradesperson an improved impact hand tool kit which can be used in general applications which require the use of an impact or non-impact type of general purpose hand tools such as chisels, punches, and screwdrivers. Such general purpose hand tools are specially adapted for use with the elongated shaft of the improved impact hand tool kit.

Yet another object of the invention is to provide the tradesperson with an improved impact hand tool kit having simple reducer adapters which will allow the use of fastening devices or specially adapted impact or non-impact general purpose impact hand tools having their attachment ends with a reduced thread size.

Still another object of the invention is to provide the tradesperson with an elongated shaft of the improved impact hand tool which is comfortable, durable and safe to use.

Accordingly, the present invention relates to an improved type of impact tool kit which provides for the tradesperson in the building construction industry or similar industry a multi-purpose impact hand tool kit which will principally allow for male or female threadable attachment of commercially available fastening devices such as concrete nails, threaded or unthreaded fastener studs, anchor/expansion plugs. Therefore to the accomplishment of the foregoing objects, the invention consists of the features hereinafter fully described and particularly pointed out in the claims, the accompanying drawings and following disclosure describing in detail the invention, such drawings and disclosure illustrating, however, but one of the various ways in which the invention may be practiced.

DETAILED DESCRIPTION OF THE PREFERRED EMBODIMENT

Figure 1:
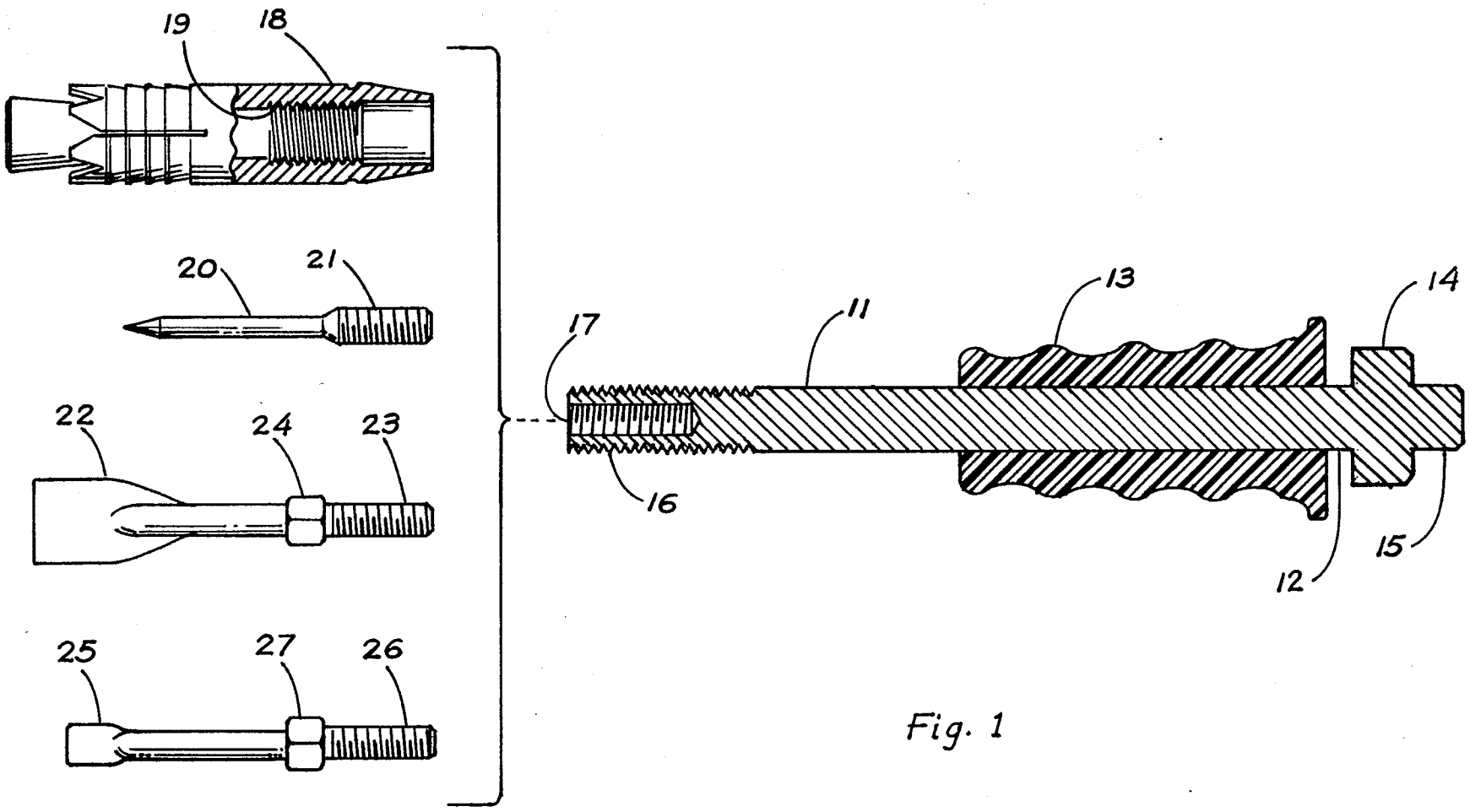
FIG. 1 is a longitudinal section of the elongated shaft of the improved impact hand tool kit shown with commercially available threaded fasteners and typical specially adapted impact or non-impact general purpose impact hand tools in accordance with the present invention.

Refering now to the drawings, and more particularly to FIG. 1, there is shown in longitudinal section the improved impact hand tool 11 having an elongated shaft 12 provided at one end with a hand grip 13, a wrench head 14 and impact end 15 and at opposite end, shaft 12 is further provided with tool end generally shown with exterior threads 16 and threaded bore 17. Threads 16 and threaded bore 17 are sized according to standard thread sizes of commercially available fasteners having external or internal thread attachment such as anchor/expansion plug 18 or threaded stud 20, respectively. As an example, the shaft 12 could be provided with exterior threads 16 to be standard five-eighth inch thread size while threaded bore 17 is tapped with standard three-eighth inch threads. The relationship in size between exterior threads 16 and threaded bore 17 must be such that there remain sufficient solid material therebetween to sustain impingement at impact end 15.

In operation, the tool 11 is threadably attached to inner threads 19 of fasteners such as anchor/expansion plug 18 or to the outer threads 21 of threaded stud 20. As an example of the multi-purpose feature of the present invention, impact general purpose hand tools such as chisel 22 can be adapted to be used with the tool 11 by adding exterior threads 23 and with wrench head 24 for torqueing to shaft 12. Similar adaptations can be made to non-impact type of general purpose hand tools such as screwdriver 25 adapted with exterior threads 26 and wrench head 27.

Figure 2:
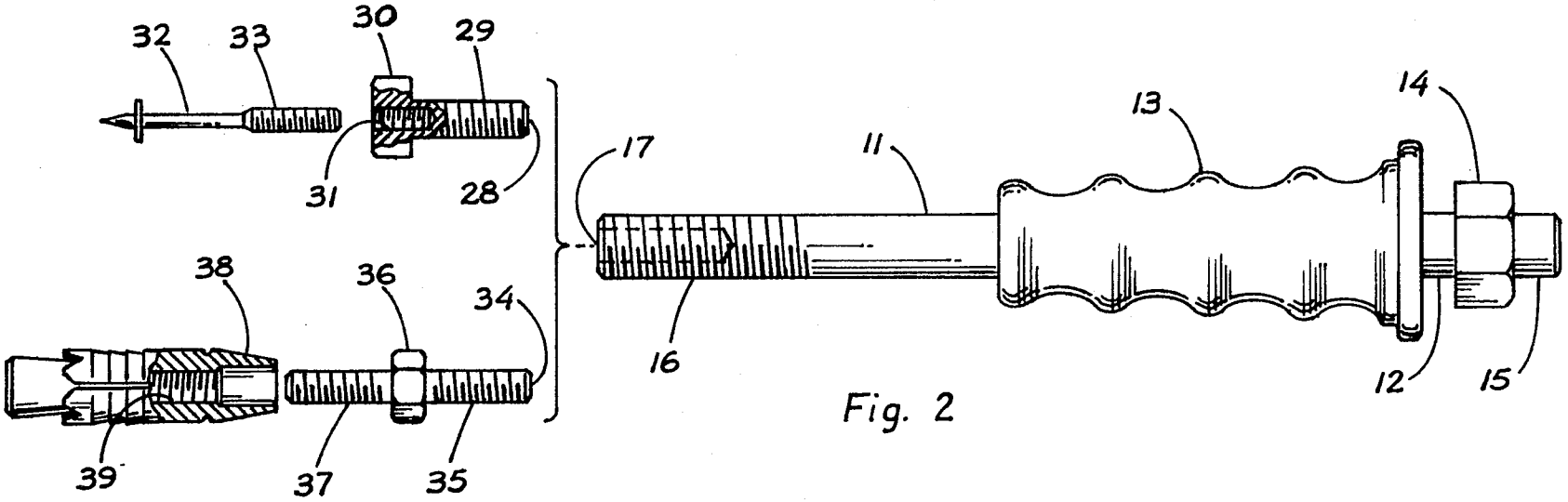
FIG. 2 is an elevational view of the elongated shaft of the improved impact tool shown with reducer adapters for male or female threaded fasteners having thread size smaller than those shown in FIG. 1.

Although tool 11 as shown in FIG. 1 can be provided with a plurality of combinations of thread sizes for the different fasteners commercially available, it is more economical for the tradesperson to have several inexpensive reducer adapters as shown in FIG. 2.0. As an example, a first reducer adapter 28 can be threadably attached by outer threads 29 on to threaded bore 17 and torqued to shaft 12 using wrench head 30. Using the same concept as with basic tool 11, smaller sized fastener 32 with outer threads 33 can be attached to threaded bore 31 of reducer 28. Similarly, for smaller sized fasteners having inner thread attachments, second reducer adapter 34 having outer threads 35 can be threadably attached to bore 17 of tool 11 and torqued thereto using wrench head 36. Second reducer adapter 34 is provide with an extended shaft having threads 37 for threadably attaching to inner threads 39 of the smaller sized, commercially available anchor/expansion plug 38.

Figure 3:
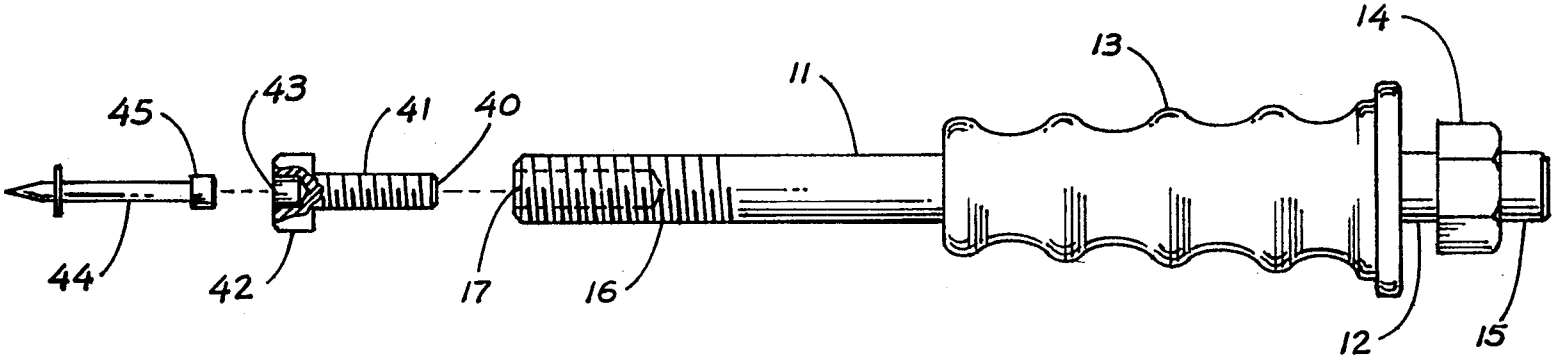
FIG. 3 is an elevational view of the elongated shaft of the improved impact tool shown with reducer adapter for a typical non-threaded fastener.

FIG. 3.0 shows additional versatility in utility by providing for the tradesperson yet a third reducer adapter for non-threaded fasteners. Reducer adapter 40 is attached in a manner just described, namely threadable attachment of outer threads 41 onto threaded bore 17 of tool 11 and torqued thereto using wrench head 42 provided on adapter 40. Wrench head 42 is further adapted by providing a recessed bore 42 which conforms to head 45 of commercially available non-threaded studs 44.

While the present invention has been shown and described herein in what is conceived to be the most practical and preferred embodiment, it is recognized that departures can be made therefrom within the scope of the invention, which is therefore not to be limited to the details disclosed herein but is to be accorded the full scope of the claims so as to embrace any and all equivalent devices.

I claim:

1. A multi-purpose, impact hand tool kit for driving a plurality of sizes of commercially available fastening devices such as, exterior threaded building fastening devices, interior threaded building fastening devices, and non-threaded impact end building fastening devices, said tool kit comprising:

(a) an elongated shaft, made of hardened material such as steel, provided with a tool end having thereat, exterior threads and a threaded bore, said exterior threads and said threaded bore being provided in a plurality of sizes for threadably attaching to said exterior threaded building fastening devices or to said interior threaded building fastening devices, said elongated shaft further provided with a hammer impact end at its other end, a wrench head located below said hammer impact end and a shock absorbing handgrip secured to said elongated shaft and located below said wrench head;

(b) a first reducer adapter having one end provided with reduced exterior threads which will threadably attach to said threaded bore of said elongated shaft, said first reducer adapter provided at its other end with a reduced tool end having thereat a reduced threaded bore, said reduced threaded bore being provided in a plurality of sizes for threadably attaching to said exterior threaded building fastening devices, said first reducer adapter further being provided with a wrench head at said reduced tool end for torqueing of said first reducer adapter to said elongated shaft whereby continuity of elongated shaft axial strength is maintained;

(c) a second reducer adapter having one end provided with a first set of reduced exterior threads which will threadably attach to said threaded bore of said elongated shaft, said second reducer adapter provided at its other end with a reduced tool end having thereat a second set of reduced exterior threads, said second set of reduced exterior threads being provided in a plurality of sizes for threadably attaching to said interior threaded building fastening devices, said second reducer adapter further being provided with a wrench head located between said first and second set of reduced exterior threads for torqueing of said second reducer adapter to said elongated shaft whereby continuity of elongated shaft axial strength is maintained; and (d) a third reducer adapter having one end provided with reducer exterior threads which will threadably attach to said threaded bore of said elongated shaft, said third reducer adapter is provided at its outer end with a tool end comprised of a wrench head with a recessed bore, said recessed bore being provided in a plurality of sizes for holding said non-threaded impact end building fastening devices, said wrench head being provided for torqueing of said third reducer adapter to said elongated shaft whereby continuity of elongated shaft axial strength is maintained.

2. A multi-purpose impact hand tool kit as recited in claim 1, whereby more uses can be provided, further comprising:

(a) impact hand tools in an assortment of sizes comprised of chisels and punches adapted with exterior threaded attachment ends, said attachment ends on said assortment of impact hand tools being suitably sized for threadably attaching to either, said threaded bore of said elongated shaft, or said reduced threaded bore of said first reducer adaptor, said impact hand tools are further adapted with a wrench head for torqueing to said elongated shaft or said first reducer adapter; and (b) non-impact hand tools in an assortment of sizes comprised of screwdrivers and saws adapted with exterior threaded attachment ends, said attachment ends on said assortment of non-impact hand tools being suitably sized for threadably attaching to either, said threaded bore of said elongated shaft, or said reduced threaded bore of said first reducer adaptor, said non-impact hand tools are further adapted with a wrench head for torqueing to said elongated shaft or said first reducer adapter.

3. A multi-purpose impact hand tool kit for driving a plurality of sizes of commercially available fastening devices such as, exterior threaded building fastening devices, interior threaded building fastening devices, and non-threaded impact end building fastening devices, said tool kit comprising:

(a) an elongated shaft, made of a hardened material such as steel, provided with a tool end having thereat, exterior threads and a threaded bore, said exterior threads and said threaded bore being provided in a plurality of sizes for threadably attaching to said exterior threaded building fastening devices or to said interior threaded building fastening devices, said elongated shaft further provided with a hammer impact end at its other end and a wrench head located below said hammer impact end;

(b) a first reducer adapter having one end provided with reduced exterior threads which will threadably attach to said threaded bore of said elongated shaft, said first reducer adapter provided at its other end with a reduced tool end having thereat a reduced threaded bore, said reduced threaded bore being provided in a plurality of sizes for threadably attaching to said exterior threaded building fastening devices, said first reducer adapter further being provided with a wrench head at said reduced tool end for torqueing of said first reducer adapter to said elongated shaft whereby continuity of elongated shaft axial strength is maintained;

(c) a second reducer adapter having one end provided with a first set of reduced exterior threads which will threadably attach to said threaded bore of said elongated shaft, said second reducer adapter provided at its other end with a reduced tool end having thereat a second set of reduced exterior threads, said second set of reduced exterior threads being provided in a plurality of sizes for threadably attaching to said interior threaded building fastening devices, said second reducer adapter further being provided with a wrench head located between said first and second set of reduced exterior threads for torqueing of said second reducer adapter to said elongated shaft whereby continuity of elongated shaft axial strength is maintained; and (d) a third reducer adapter having one end provided with reduced exterior threads which will threadably attach to said threaded bore of said elongated shaft, said third reducer adapter is provided at its other end with a tool end comprised of wrench head with a recessed bore, said recessed bore being provided in a plurality of sizes for holding said non-threaded impact end building fastening devices, said wrench head being provided for torqueing of said third reducer adapter to said elongated shaft whereby continuity of elongated shaft axial strength is maintained.

* * * * *